US006023033A

United States Patent [19]

Yagi et al.

[11] Patent Number: 6,023,033

[45] Date of Patent: Feb. 8, 2000

[54] KEYTOP PLATE AND METHOD FOR PRODUCING THE SAME

[75] Inventors: Nobuyuki Yagi; Jiro Inagaki; Tatsuya Okamura, all of Tokyo, Japan

[73] Assignee: Teikoku Tsushin Kogyo Co., Ltd., Kawasaki, Japan

[21] Appl. No.: 08/980,816

[22] Filed: Dec. 1, 1997

[30] Foreign Application Priority Data

Nov. 29, 1996 [JP] Japan ..... 8-334600

[51] Int. Cl.[7] ..... H01H 13/70; H01H 3/12

[52] U.S. Cl. ..... 200/512; 29/622; 200/5 A; 200/341

[58] Field of Search ..... 200/5 A, 512, 200/513, 516, 517, 341, 344, 345, 308, 310, 313, 314, 317; 400/490, 491.2, 494, 495; 29/622

[56] References Cited

U.S. PATENT DOCUMENTS

| | | | |
|---|---|---|---|
| 4,395,817 | 8/1983 | Asada et al. | 29/622 |
| 4,937,408 | 6/1990 | Hattori et al. | 200/314 |
| 5,234,744 | 8/1993 | Kenmochi | 428/195 |
| 5,280,146 | 1/1994 | Inagaki et al. | 200/341 |
| 5,362,934 | 11/1994 | Inagaki et al. | 200/520 |
| 5,399,821 | 3/1995 | Inagaki et al. | 200/341 |
| 5,475,192 | 12/1995 | Inagaki et al. | 200/341 |
| 5,613,599 | 3/1997 | Inagaki et al. | 200/512 |

FOREIGN PATENT DOCUMENTS

| | | | |
|---|---|---|---|
| 616 345 | 9/1994 | European Pat. Off. | H01H 13/70 |
| 41 07 841 | 9/1992 | Germany | G05G 1/02 |
| 2 261 769 | 5/1993 | United Kingdom | H01H 11/00 |

*Primary Examiner*—Michael Friedhofer
*Attorney, Agent, or Firm*—Wenderoth, Lind & Ponack, L.L.P.

[57] ABSTRACT

A keytop plate comprises keytops (21) formed by integrally molding a molding resin part (25) with a synthetic resin film (23), and a molded elastomer sheet (molded elastomer member) (11) attached to the keytops (21). The molded elastomer sheet (11), other than in the areas to which the keytops (21) are attached, has no through-holes, whereby a water-proof property is provided. The keytops (21) are easily depressed even when the molded elastomer sheet (11) is securely held at its peripheral portion. A hard tactile feeling may be obtained when the keytops (21) are depressed, since the keytops (21) are formed from the synthetic resin film (23) and the molding resin part (25).

11 Claims, 7 Drawing Sheets

KEYTOP PLATE AND METHOD FOR PRODUCING THE SAME

BACKGROUND OF THE INVENTION

This invention relates to a keytop plate and a method for producing the same.

Conventionally, some electronic devices are used in an environment where invasive dust or moisture is present. Accordingly, push-button switches to be used as a control part for such electronic devices are required to have a construction which prevents invasion of dust or moisture into contact with the switches. In other words, the switches need a dust-proof and moisture-proof or water-proof construction.

In order to meet the above-mentioned requirements, a switching plate for push buttons of a construction shown in FIG. 12 has been proposed. The switching plate for push buttons includes a keytop plate 85 with no through-holes therein disposed above a switch substrate 71, and a casing 95 disposed on the keytop plate 85. The keytop plate 85 is bonded, along its entire periphery C, to the lower surface of the casing 95.

The keytop plate 85 includes a synthetic resin film 87 of polyethylene terephthalate (referred to as "PET" hereinbelow), and a plurality of resin parts 88 molded to the synthetic resin film 87 at predetermined positions, whereby a plurality of keytops 89 are formed. A plurality of switch contacts 73 are disposed on the switch substrate 71 at positions opposite to the respective keytops 89. A click plate 75 is disposed on each of the switch contacts 73.

When any one of the keytops 89 is depressed, the keytop plate 85 is deflected so as to allow the depressed keytop 89 to be lowered. By this, the corresponding click plate 75 is depressed and deformed into a reverse configuration. Simultaneously, the corresponding switch contact 73 is turned on.

Due to the above-mentioned construction, any water droplets, dirt, or dust, having impinged on the casing 95 and/or the-keytop plate 85, may be prevented from getting to the substrate 71. Thus, a water-proof and/or dust-proof property for the switch plate may be obtained.

It is noted, however, that although the synthetic resin film 87 has flexibility and is easily deformed, it has substantially no ductility. Accordingly, and in the case of the prior art example shown in FIG. 12, the synthetic resin film 87 is difficult to deform or deflect when any one of the keytops 89 is depressed so as to be lowered by its depression stroke, since the synthetic resin film 87 is secured, along its periphery C, to the casing 95. This causes a problem in that the keytops are difficult to depress. This problem becomes more significant as the keytops are miniaturized specifically in accordance with miniaturization of electronic devices.

In order to overcome the above mentioned problem, a keytop plate 85-2 of a construction shown in FIG. 13 has been proposed.

The keytop plate 85-2 includes a sheet 87-2 and keytops 89-2. The sheet 87-2 and the keytops 89-2 are integrally molded from silicone rubber. Thus, the keytop plate 85-2 allows the keytops 89-2 to be easily depressed even when the keytop plate 85-2 is securely held along its entire periphery, since silicone rubber may be easily extended.

It is noted, however, that the above-mentioned keytop plate 85-2 provides a relatively soft tactile feeling when any one of the keytops 89-2 is depressed, since the keytops are made from silicone rubber which is flexible by nature. Thus, a hard tactile feeling, which is preferable to most users and which may be provided by molded resin, could not be obtained.

When printing desired markings or characters on the surface of each of the keytops 89-2 of the keytop plate 85-2, such printing operation should be performed directly on the surface of each of the individual keytops 89-2 having a substantially cubic configuration. Such printing operation is complex and less efficient, when compared to a printing operation in which a marking or the like is directly printed on a sheet. It is also difficult to perform a fine printing. It is also noted that, when a plurality of keytops 89-2 are simultaneously printed with a marking, misregistration between the keytops 89-2 and a printing means would occur, since the keytop plate 85 has flexibility. As a result, simultaneous printing of a marking or the like on the keytops 89-2 is impossible. This reduces the efficiency of the printing operation.

SUMMARY OF THE INVENTION

Accordingly, it is an object of the invention to provide a keytop plate and a method for producing the same which: permits keytops to be easily depressed even when the peripheral portion of the keytop plate is securely held; provides a hard tactile feeling of the keytops when depressed; and allows printing of marks or the like on the keytops in an efficient manner.

The main feature of the invention resides in that the keytop plate includes keytops formed by integrally molding a molding resin with a synthetic resin film, and a molded elastomer member is attached to the keytops.

The molded elastomer member to which the keytops are attached is flexible so that it may be extended easily. Thus, the keytops may be easily depressed even when the peripheral portion of the molded elastomer member is secured, for example, to a casing in order to provide water-proof and dust-proof properties of the keytop plate. The keytops are hard, since they are formed by integrally molding the molding resin with the synthetic resin film. Thus, a hard tactile feeling may be obtained when the keytops are depressed.

Another main feature of the invention resides in that the area of the molded elastomer member, other than the areas to which the keytops are attached, has no through-holes. Thus, a water-proof capability is provided.

Another main feature of the invention resides in that the molded elastomer member comprises a molded elastomer sheet.

Another main feature of the invention resides in a method for producing the keytop plate which comprises the steps of: molding a molding resin at predetermined positions of a synthetic resin film so as to form a plurality of keytops; attaching a molded elastomer member to the keytops; and removing all or most of at least the portion of the synthetic resin film around each keytop, while-leaving the molded elastomer member.

Still another feature of the invention resides in that the above-mentioned method further comprises a step of preliminarily providing a printed portion by printing prior to the step of forming the keytops on the synthetic resin film.

BRIEF DESCRIPTION OF THE DRAWINGS

For a fuller understanding of the nature and objects of the present invention, reference should be had to the following detailed description taken in connection with the accompanying drawings wherein.

DESCRIPTION OF THE PREFERRED EMBODIMENTS

Several embodiments of the invention will be explained in detail below with reference to the drawings.

[First Embodiment]

Figure 1A:
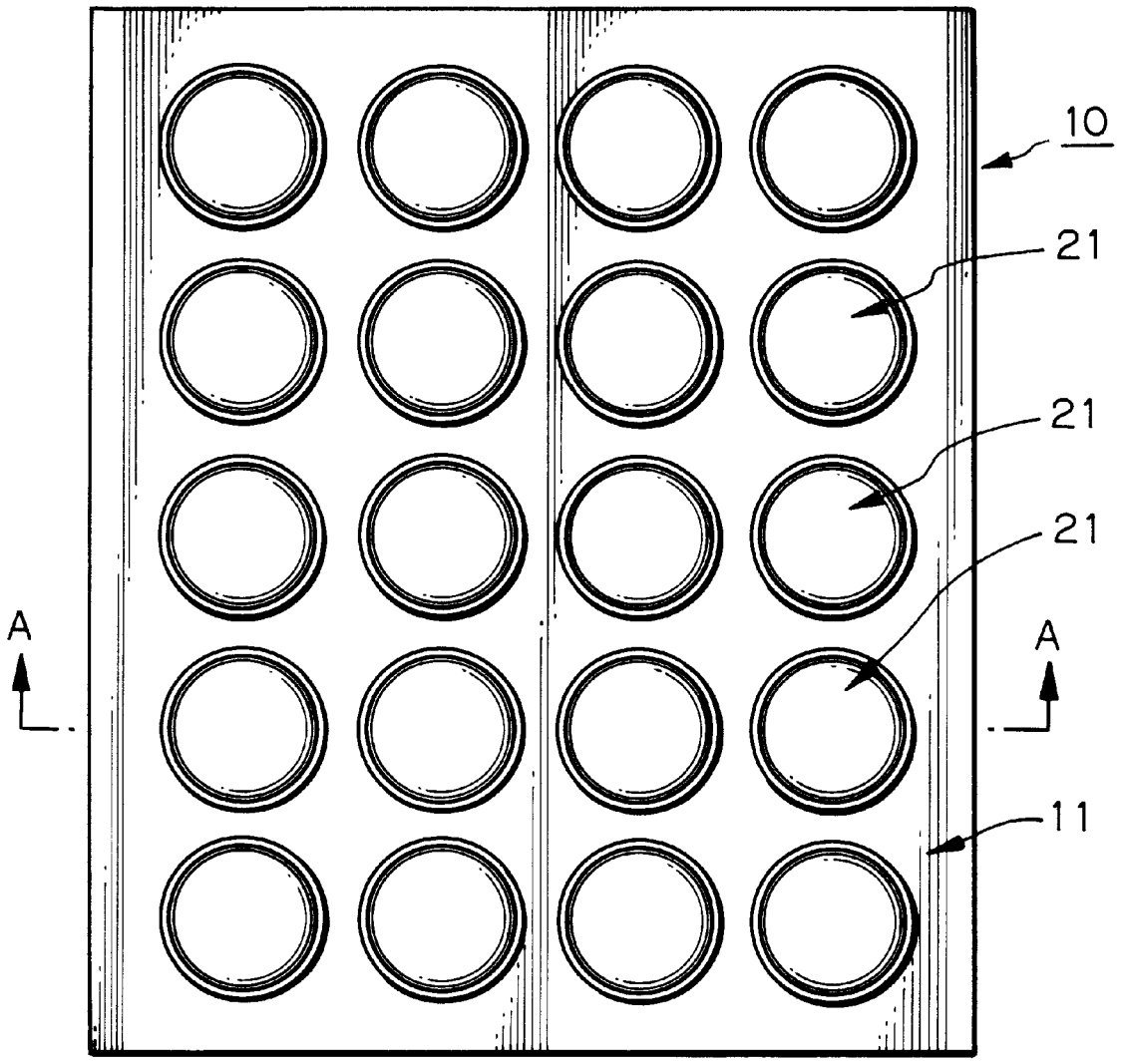
FIGS. 1(*a*) and (*b*) show a keytop plate 10 according to a first embodiment of the invention, wherein FIG. 1(*a*) is a plan view, and FIG. 1(*b*) is a sectional view along line A—A in FIG. 1(*a*)
Figure 1B:
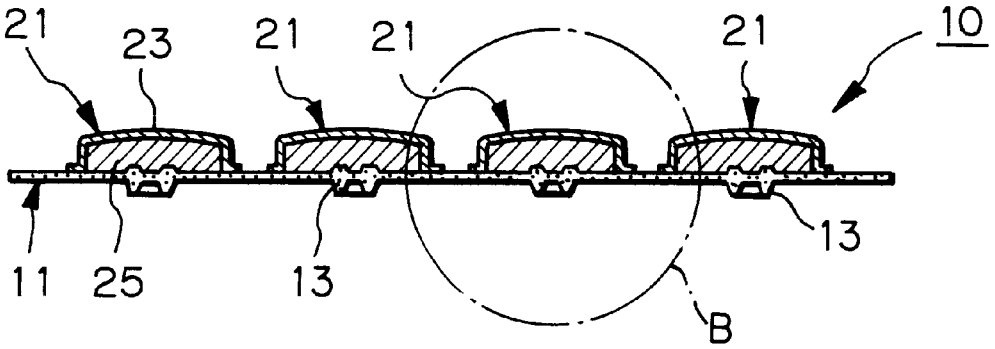

FIGS. 1(*a*) and (*b*) are views showing a keytop plate 10 according to a first embodiment of the invention, wherein FIG. 1(*a*) is a plan view, and FIG. 1(*b*) is a sectional view along line A—A of FIG. 1(*a*).

As shown in FIG. 1(*a*), the keytop plate 10 includes a molded elastomer sheet (molded elastomer member) 11 of a flat plate configuration, and a plurality of keytops 21 attached to the upper surface of the molded elastomer sheet 11. In the illustrated embodiment, twenty keytops 21 in total are arranged in five (5) rows by four (4) columns. Each component of the keytop plate 10 according to this embodiment will be explained in detail below.

In FIG. 1(*a*), the molded elastomer sheet 11 has a configuration of a substantially rectangular flat plate and is molded to have no through holes therein. A presser protrusion 13 is provided on the lower surface of the molded elastomer sheet 11 at a portion below each keytop 21. Each presser protrusion 13 is centrally located in that portion and extends in the downward direction.

It is noted that the molded elastomer sheet 11 is formed from a transparent or translucent thermoplastic elastomeric material, such as a polyester based elastomeric material.

Figure 2:
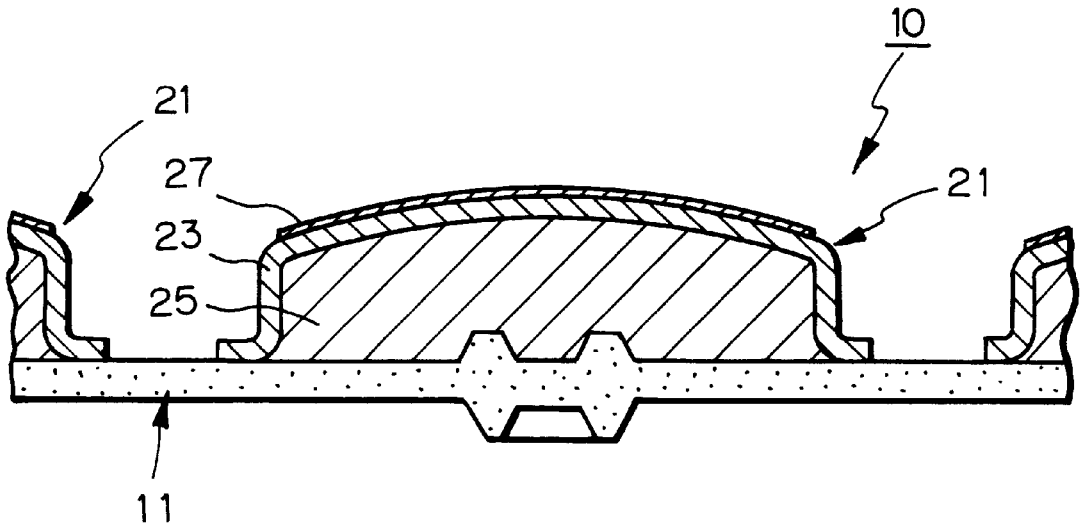
FIG. 2 is an enlarged view of the portion B in FIG. 1(*b*)

FIG. 2 is an enlarged view showing the portion indicated by reference FIG. B in FIG. 1(*b*). As shown in FIG. 2, each keytop 21 includes a synthetic resin film 23 formed into a curved configuration to have a convex portion facing in the upward direction, and a molded resin part 25 integrally molded with the synthetic resin film 23 on the lower surface of the synthetic resin film 23. The synthetic resin film 23 is provided, on the upper surface thereof, with printed portions 27 having desired character(s), symbol(s) or graphic(s) thereon. Each molded resin part 25 is bonded, over its entire lower surface, to the upper surface of the molded elastomer sheet 11.

The synthetic resin film 23 may be a transparent or translucent thermoplastic resin film, such as a transparent PET film. The molded resin part 25 may be a transparent or translucent thermoplastic molded resin, such as polycarbonate (PC), polymethylmethacrylate (PMMA), PC/PET alloy or the like.

Figure 3:
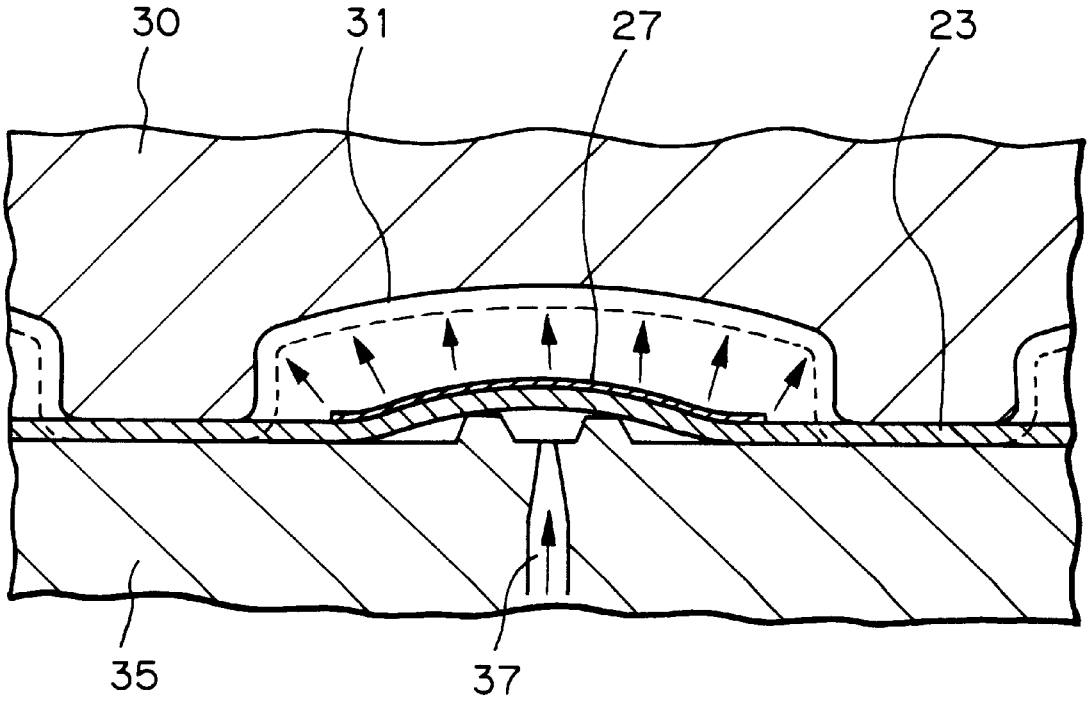
FIG. 3 illustrates one process step of the method of producing the keytop plate 10.
Figure 4:
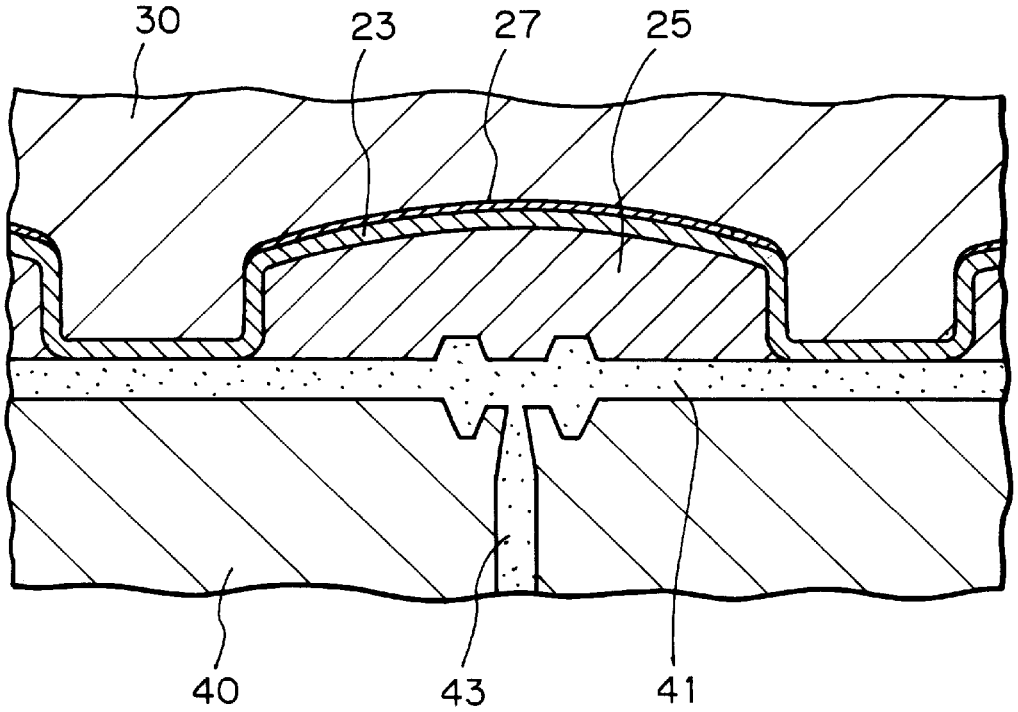
FIG. 4 illustrates another process step of the method of producing the keytop plate 10.
Figure 5:
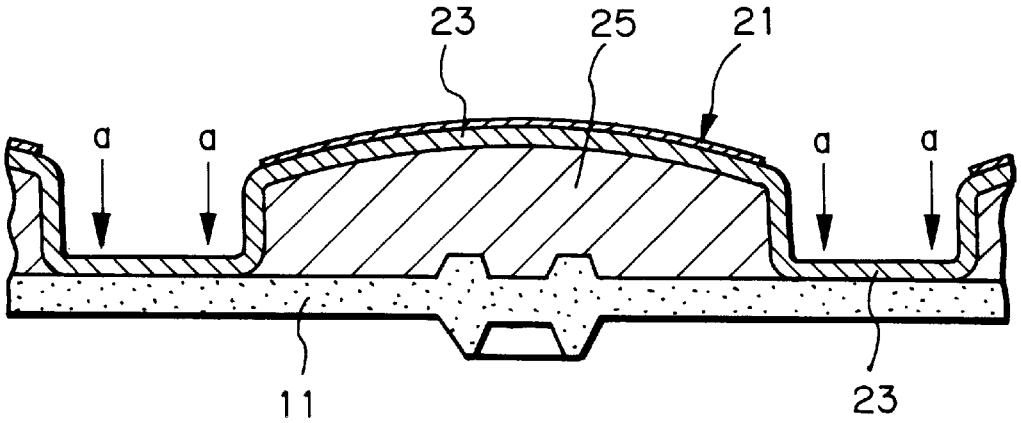
FIG. 5 illustrates another process step of the method of producing the keytop plate 10.

A method for producing the keytop plate 10 will be explained below. FIGS. 3 to 5 illustrate process steps of the method for producing the keytop plate 10.

First, a synthetic resin film 23 of a plate-like configuration having a desired printed portion 27 on its upper surface is clamped between a first mold 30 and a second mold 35, as shown in FIG. 3. The first mold 30 includes recesses 31 each having a configuration the same as that of the upper surface of the keytop 21. The second mold includes pin gate 37.

A flow of melted molding resin under pressure at a high temperature (for example, approximately 260 degree C.) is injected through the pin gate 37. The portion of the synthetic resin film 23 facing the recess 31 is extended and deformed, due to the heat and pressure of the melted molding resin, so as to be raised upwardly as shown by the arrow mark in FIG. 3. The mass of the injected molding resin comes closely in contact with the inner surface of the recess 31, and the recess 31 is filled with the molded resin part 25 (refer to FIG. 2). Then, the molded resin part 25 is cooled and consolidated. It is noted that the molded resin part 25 and the deformed synthetic resin film 23 may be securely bonded together in a direct and strong manner, without providing any adhesive therebetween. The molded resin part 25 and the synthetic resin film 23 may, of course, be bonded together using a suitable adhesive interposed therebetween.

Instead of deforming the synthetic resin film 23 into a curved configuration using the heat and pressure of the melted molding resin injected through the pin gate 37, the synthetic resin film 23 itself may be preliminarily formed into a desired configuration (preforming). The preformed synthetic resin film is then clamped between the first and second molds 30, 35. Thereafter, the recess 31 of the synthetic resin film 23 is filled with the melted molded resin part 25. The process of preforming the synthetic resin film 23 may be performed, for example, by a vacuum forming or a pressure forming method in which the synthetic resin film 23 is first heated to be softened, then formed into a desired configuration when softened by applying an external force (vacuum force or compressed air force). Thereafter, it is cooled to be consolidated. The synthetic resin film 23 may also be performed by a preforming method using a press.

Then, the second mold 35 is removed, and a third mold 40 is disposed in opposite relationship with the first mold 30, as shown in FIG. 4. The third mold 40 includes, on the surface thereof opposite to the first mold 30, recesses 41 having a configuration the same as that of the lower surface of the molded elastomer sheet 11 (refer to FIG. 2), and pin gates 43.

A flow-of melted elastomeric material is injected through the pin gate 43 into the recess 41. By this, the recess 41 is filled with the melted elastomeric material. The melted elastomeric material is then consolidated. It is noted that the elastomer resin and the molded resin part 25 may be directly and strongly bonded together, without providing any adhesive therebetween. In this connection, it is noted that the elastomer resin in the recess 41 and the molded resin part 25 may, of course, be bonded together using a suitable adhesive. In this connection, it is to be noted that the elastomer resin in the recess 41 and the synthetic resin film 23 are not bonded together.

The first mold 30 and the third mold 40 are removed as shown in FIG. 5. Then, the portion (indicated by reference FIG. "a") of the synthetic resin film 23 around each keytop 21 is cut away using a laser. In this connection, it is noted that duration and output of the laser is controlled so as to completely cut the synthetic resin film 23, while slightly cutting the molded elastomer sheet 11 in its surface layer (to the depth less than approximately half the thickness of the molded elastomer sheet 11).

Then, all the portions of the synthetic resin film 23 which are not disposed on the keytops 21 are stripped off from the molded elastomer sheet 11, whereby the keytop plate 10 of a construction shown in FIGS. 1 and 2 is completed.

Figure 6:
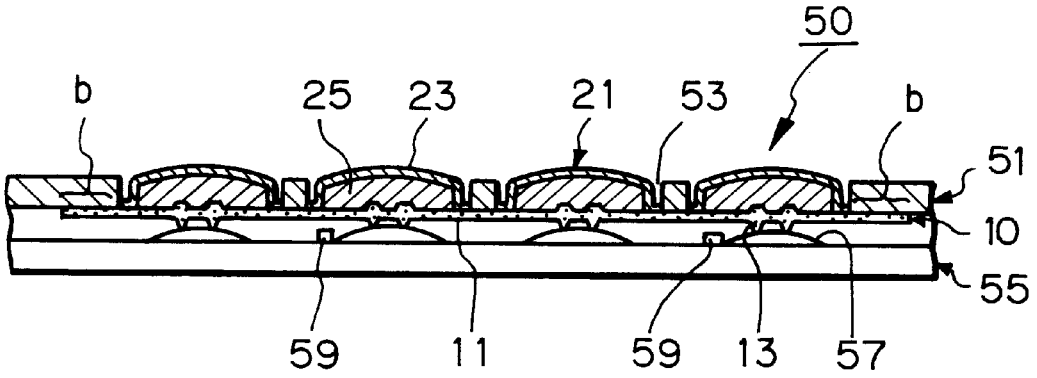
FIG. 6 is a side elevational view, in section, of one example of a switch plate 50 for push buttons of a waterproof construction, in which the keytop plate 10 is employed.

FIG. 6 is a side elevational view, in section, of one example of switch plates 50 of a water-proof construction for push buttons in which the above-mentioned keytop 10 is employed. As shown in FIG. 6, the keytop 10 is ultrasonically welded, along its entire upper peripheral portion b, to the lower surface of a casing 51.

The casing 51 is provided, at the portion opposite to each keytop 21, with a through-hole 53. The surface of each of the keytops 21 is exposed exteriorly through the through-holes 53.

A switch substrate 55 is disposed below the keytop plate 10. The switch substrate 55 is provided, at the portion opposite to each presser protrusion 13, with a click plate (or movable contactor) 57. A switch contact (not shown) is disposed below each click plate 57 of the switch substrate 55. The switch substrate 55 is also provided, at predetermined positions, with light emission elements 59 for illumination purpose.

In the illustrated embodiment, the molded elastomer sheet 11 is not provided with through-holes. Thus, it is possible to prevent water and/or dust present on the casing 51 from entering into the casing 51 by simply welding the peripheral portion of the molded elastomer sheet 11 to the casing 51, whereby water-proof and dust-proof properties are obtained.

It is noted that the keytop plate 10 may be bonded, at its peripheral portion, to the casing 51, by using a suitable adhesive. It is also noted that a spacer means (not shown) may be disposed below the lower surface of the outer peripheral portion of the keytop plate 10. Therefore, the outer peripheral portion of the keytop plate 10 may be clamped, in water-proof manner, between the spacer means and the casing 51.

When any one of the keytops 21 is depressed, the molded elastomer sheet 11 is lowered by reason of its deformability and ductility. Thus, a corresponding click plate 57 is urged downward by the pressure protrusion 13 of the keytop 21, so as to be deformed into a reversed configuration (inverted), whereby the corresponding switch contact is turned on.

In this connection, it is to be noted that, although the keytop plate 10 is secured at its peripheral portion to the casing 51, each keytop 21 may be easily depressed. They may each be easily depressed because the keytops 21 are disposed on the molded elastomer sheet 11 which is flexible and ductile. This effect may also be obtained, even when the keytop plate 21 is miniaturized.

It is noted that each keytop 21 is hard, since it is constructed by integrally molding the synthetic resin film 23 and the molding resin part 25. Accordingly, a hard tactile feeling may be obtained when the keytops 21 are depressed.

Figure 13:
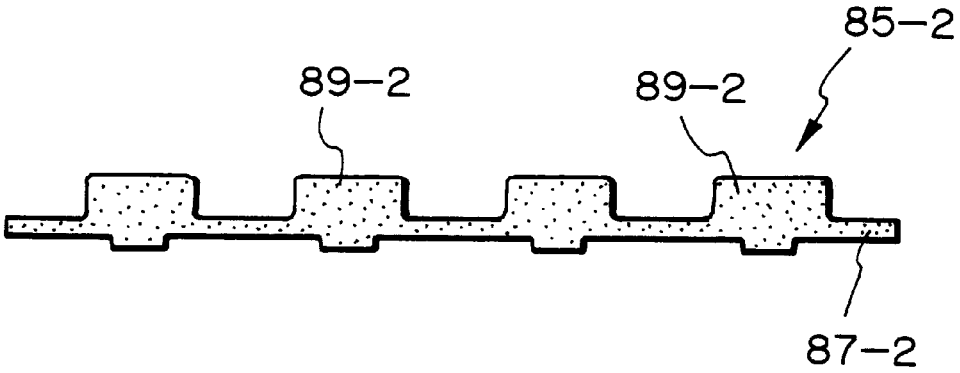
Fig. 13 PRIOR ART
FIG. 13 is a side elevational view, in section, of another keytop plate 85-2 in the prior art.

In the illustrated embodiment, the printed portion 27 is provided on the synthetic resin film 23. It is noted that misregistration is not caused when the synthetic resin film 23 is printed upon. Thus, it is possible to provide a large-sized synthetic resin film 23, so that printed portions 27 for a plurality of keytop plates 10 may be simultaneously printed on such large-sized synthetic resin film. The thus-formed large-sized synthetic resin film may be integrally molded with mold resin. It is noted that no misregistration is caused during such operation. This process permits easy mass-production of the keytop plates, when compared to the prior art process shown in FIG. 13 in which printing operation is performed on the individual keytops 89-2 on the keytop plate 85-2. It is also noted that printing operation relative to the synthetic resin film 23 permits multi-color printing and/or fine printing to be performed easily.

When the light emission elements 59 are illuminated, each keytop 21 may be illuminated from its backside, through the transparent or translucent molded elastomer sheet 11, molded resin part 25 and synthetic resin film 23.

[Second Embodiment]

Figure 7:
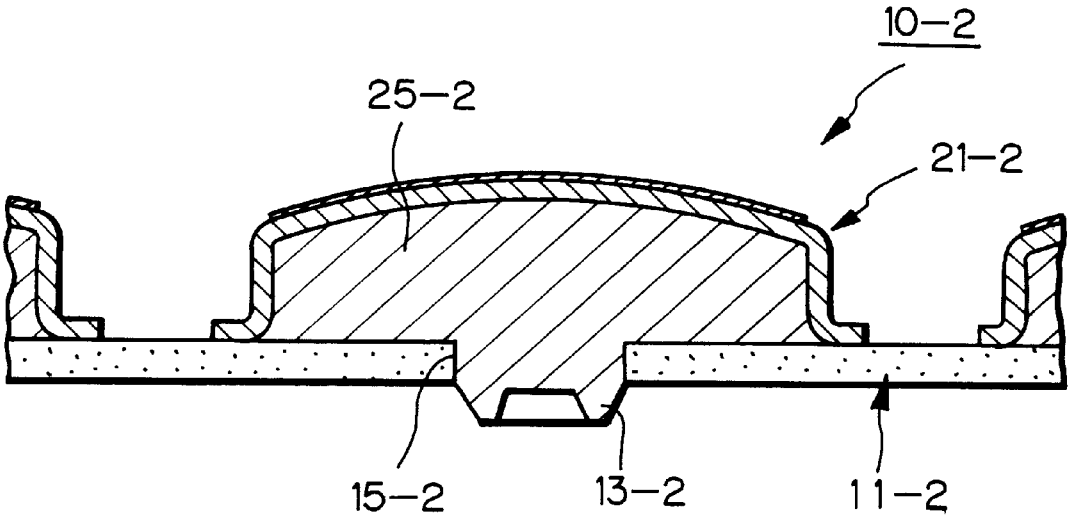
FIG. 7 is a side elevational view, in section, of a main part of a keytop plate 10-2 according to a second embodiment of the invention.

FIG. 7 is a side-elevation, cross-sectional view of a main portion of a keytop plate 10-2 according to a second embodiment of the invention. The keytop plate 10-2 is only different from the keytop plate 10 according to the first embodiment by the fact that a presser protrusion 13-2 is extended from the central portion of the lower surface of the molded resin part 25-2 forming the keytop 21-2, and that the presser protrusion 13-2 is extended through a through-hole 15-2 in a molded elastomer sheet 11-2.

According to the second embodiment of the invention, the presser protrusion 13-2, urging the click plate (or movable contactor), may also be formed from the molded resin part 25-2, so that a harder tactile feeling is advantageously obtained, when the keytop 21-2 is depressed.

In this embodiment, each through-hole 15-2 in the molded elastomer sheet 11-2 is plugged by the keytop 21-2. Thus, water-proof and dust-proof properties may be obtained, as in the case of the first embodiment.

[Third Embodiment]

Figure 8:
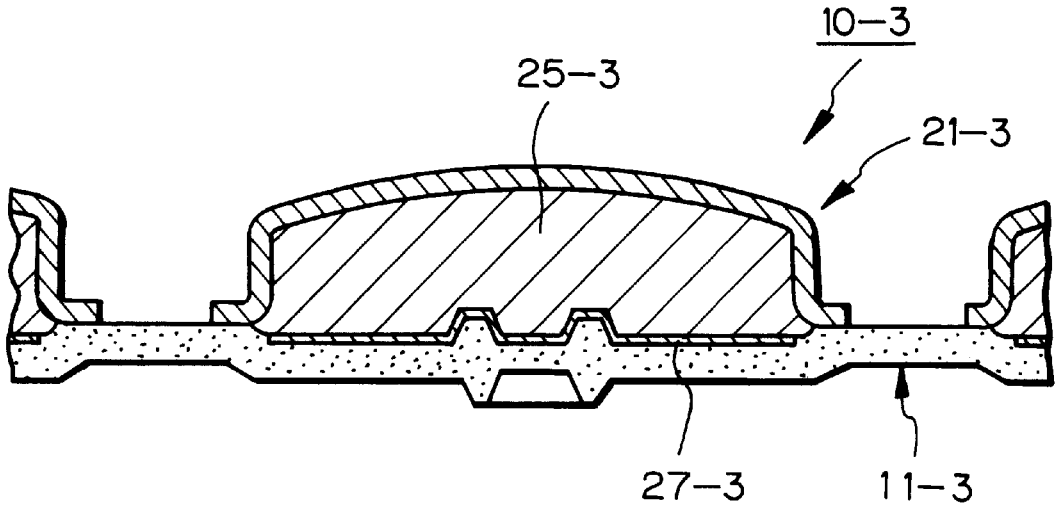
FIG. 8 is a side elevational view, in section, of a main part of a keytop plate 10-3 according to a third embodiment of the invention.

FIG. 8 is a side-elevational, cross-sectional view of a main portion of a keytop plate 10-3 according to a third embodiment of the invention. The keytop plate 10-3 is only different from the keytop plate 10 according to the first embodiment by the fact that a printed portion 27-3 is provided on the lower surface of a molded resin part 25-3. In the case of the molded resin part 25-3 and the molded elastomer sheet 11-3 being bonded together imperfectly, due to the presence of the printed portion 27-3 therebetween, any suitable adhesive layer may be provided between the molded resin part 25-3 and the molded elastomer sheet 11-3.

[Fourth Embodiment]

Figure 9:
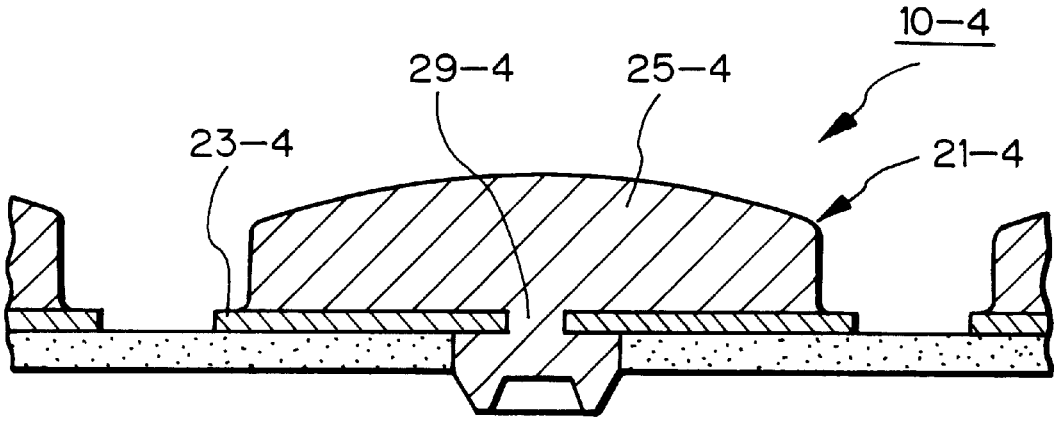
FIG. 9 is a side elevational view, in section, of a main part of a keytop plate 10-4 according to a fourth embodiment of the invention.

FIG. 9 is a side-elevational, cross-sectional view of a main portion of a keytop plate 10-4 according to a fourth embodiment of the invention. The keytop plate 10-4 is only different from the keytop plate 10-2 according to the second embodiment by the fact that a synthetic resin film 23-4 forming keytops 214 is not curved, but provided with a through-hole 29-4 at a position corresponding to each keytop 21-4. A molded resin part 25-4 is formed through the through-hole, on opposite sides of the synthetic resin film 23-4. Although not shown in the drawing, it is preferable to provide a printed portion on the synthetic resin film 23-4.

[Fifth Embodiment]

Figure 10:
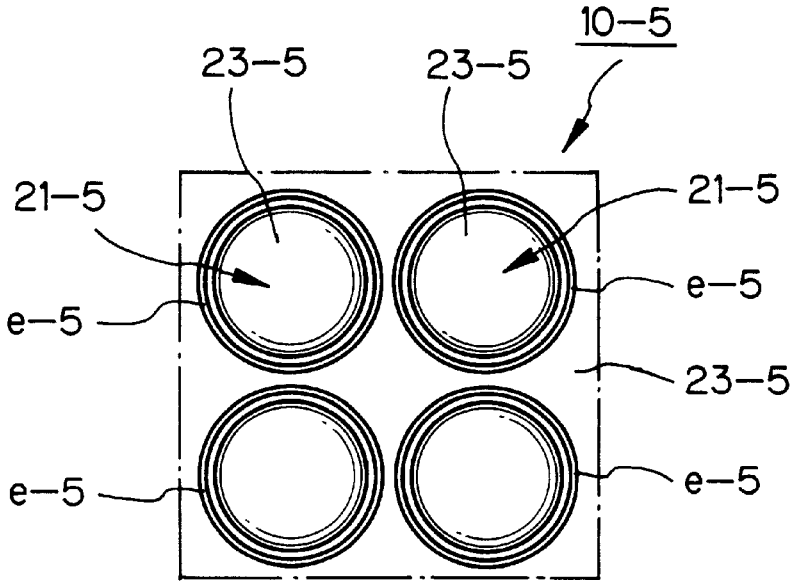
FIG. 10 is a side elevational view, in section, of a main part of a keytop plate 10-5 according to a fifth embodiment of the invention.

FIG. 10 is a plan view of a main portion of a keytop plate 10-5 according to a fifth embodiment of the invention. The keytop plate 10-5 is only different from the keytop plate 10 according to the first embodiment by the fact that only the area e-5 around each keytop 21-5 of a synthetic resin film 23-5 is cut away by a laser in an annular form. The remaining portion of-the synthetic resin film 23-5 other than each of the areas e-5 is adhesively bonded to a molded elastomer sheet by adhesives and the like.

Figure 12:
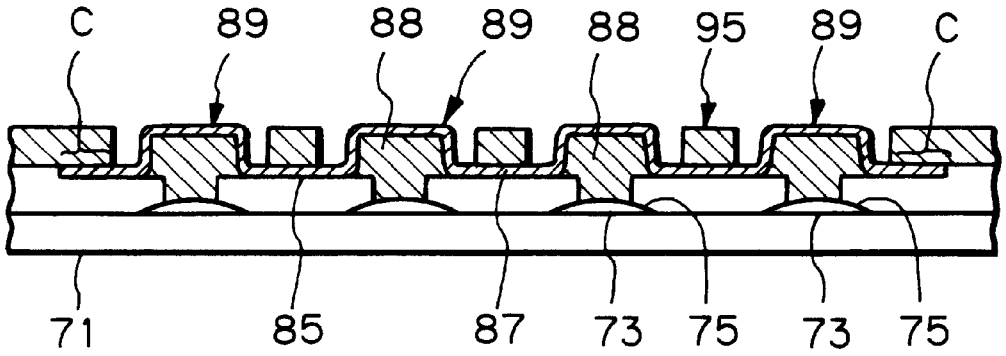
Fig. 12 PRIOR ART
FIG. 12 is a schematic, side elevational view, in section, of a switch plate for push buttons in the prior art.

With this construction, it is also possible for the keytops 21-5 to be easily depressed, as compared with the prior art shown in FIG. 12, even when the peripheral portion of the keytop plate 10-5 is securely held, since at least the area e-5 around each keytop 21-5 has flexibility.

[Sixth Embodiment]

Figure 11:
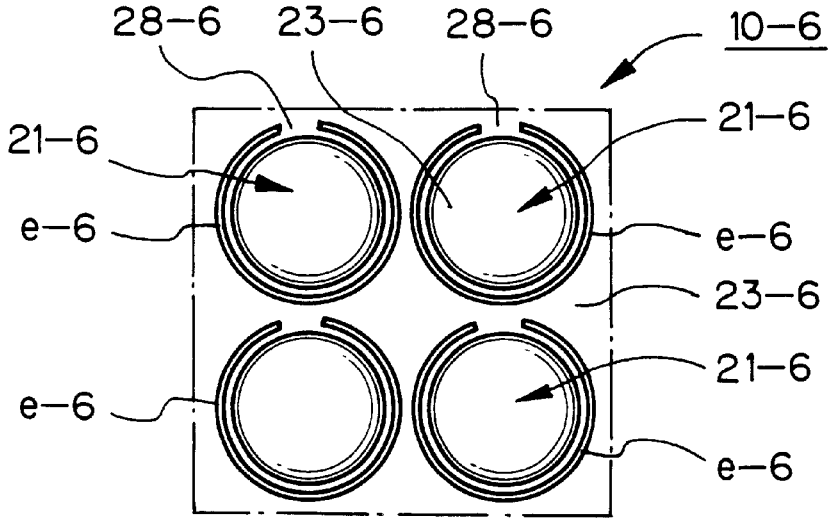
FIG. 11 is a side elevational view, in section, of a main part of a keytop plate 10-6 according to a sixth embodiment of the invention.

FIG. 11 is a plan view of a main portion of a keytop plate 10-6 according to a sixth embodiment of the invention. The keytop plate 10-6 is only different from the keytop plate 10-5 according to the fifth embodiment by the fact that the area e-6 of a synthetic resin film 23-6 around each keytop 21-6 is not completely removed in an annular configuration, so as to leave a hinge portion 28-6, whereby each keytop 21-6 is connected to the synthetic resin film 23-6 around it. In this embodiment, the remaining portion of the synthetic resin film 23-6 other than each of the areas e-6 is adhesively bonded to the molded elastomer sheet by adhesives and the like.

With this construction, it is also possible for the keytops 21-6 to be easily depressed, as compared with the prior art shown in FIG. 12, even when the peripheral portion of the keytop plate 10-6 is securely held, since at least the area e-6 around each keytop 21-6 has flexibility.

The invention may be practiced in various ways without departing from the spirit or main features of the invention. Thus, all of the aforementioned embodiments, in any respect, are merely given as an example and should not be construed as limiting. The scope of the invention is solely defined by the appended claims and should not be limited by the description of the body of the Specification. It is also noted that variations and modifications belonging to the claims in terms of the -doctrine of equivalent fall under the purview of-the invention.

What is claimed is:

1. A method for producing a keytop plate, comprising:

molding a molding resin at predetermined positions of a synthetic resin film so as to form a plurality of keytops;

attaching a molded elastomer member to said keytops; and removing at least a major portion of said synthetic resin film around each of said keytops, while leaving said molded elastomer member.

2. The method for producing a keytop plate according to claim 1, further comprising preliminarily providing a printed portion by printing on said synthetic resin film, prior to said molding of a molding resin at predetermined positions of said synthetic resin film.

3. The method for producing a keytop plate according to claim 1, further comprising providing a printed portion on a lower surface of a molded resin part formed by said molding of a molding resin at predetermined positions of said synthetic resin film.

4. A keytop plate comprising:

a plurality of keytops, each of said keytops having a molded resin part and a synthetic resin film, and each of said keytops being formed by integrally molding said molded resin part with said synthetic resin film; and a molded elastomer sheet, said plurality of keytops being attached to a surface of said molded elastomer sheet.

5. The keytop plate of claim 4, wherein a printed portion is provided on said synthetic resin film.

6. The keytop plate of claim 5, wherein said molded resin part of each of said keytops has an upper surface and a side surface, and each of said keytops is arranged such that said synthetic resin film covers said upper surface and said side surface of said molded resin part.

7. The keytop plate of claim 6, wherein said molded elastomer sheet includes a plurality of through-holes, and said molded resin part of each of said keytops includes a presser protrusion extending through one of said through-holes in said molded elastomer sheet.

8. The keytop plate of claim 4, wherein said molded resin part of each of said keytops has an upper surface and a side surface, and each of said keytops is arranged such that said synthetic resin film covers said upper surface and said side surface of said molded resin part.

9. The keytop plate of claim 8, wherein said molded elastomer sheet includes a plurality of through-holes, and said molded resin part of each of said keytops includes a presser protrusion extending through one of said through-holes in said molded elastomer sheet.

10. The keytop plate of claim 4, wherein said molded elastomer sheet includes a plurality of through-holes, and said molded resin part of each of said keytops includes a presser protrusion extending through one of said through-holes in said molded elastomer sheet.

11. The keytop plate of claim 4, wherein at least a major portion of said molded elastomer sheet surrounding each of said keytops is not covered with said synthetic resin film.

* * * * *